US005611468A

United States Patent [19]

Schulze et al.

[11] Patent Number: 5,611,468

[45] Date of Patent: Mar. 18, 1997

[54] FOLDING DEVICE FOR AN AUTOMATIC SEWING MACHINE

[75] Inventors: Wolfram Schulze, Bielefeld, Germany; John Couch, Stone Mountain, Ga.; Wolfgang Grosser, Bielefeld; Herbert Zielinski, Spenge, both of Germany

[73] Assignee: Durkopp Adler Aktiengesellschaft, Germany

[21] Appl. No.: 647,239

[22] Filed: May 9, 1996

[30] Foreign Application Priority Data

May 24, 1995 [DE] Germany ..... 195 19 027.0
Mar. 7, 1996 [DE] Germany ..... 196 08 779.1

[51] Int. Cl.[6] ..... A41H 33/00

[52] U.S. Cl. ..... 223/38; 223/37; 112/470.07; 112/470.16; 112/470.06

[58] Field of Search ..... 223/37, 38; 112/147, 112/470.07, 470.16, 475.06

[56] References Cited

U.S. PATENT DOCUMENTS 4,819,572 4/1989 Scholl et al. .
5,058,517 10/1991 Morii et al. ..... 223/38
5,174,480 12/1992 Otokuni ..... 223/38
5,333,563 8/1994 Yamanoi ..... 112/475.06
5,381,937 1/1995 Thompson et al. ..... 223/37

FOREIGN PATENT DOCUMENTS

4413814A1 10/1994 Germany .

*Primary Examiner*—Bibhu Mohanty
*Attorney, Agent, or Firm*—Laff, Whitesel, Conte & Saret, Ltd.

[57] ABSTRACT

Above a workpiece-receiving plate for an lower workpiece, a folding device for an automatic sewing machine comprises two swords, namely a lower sword and an upper sword for receiving an intermediate workpiece and an upper workpiece, respectively. For the folding of the intermediate workpiece about the outer edges of the lower sword, folding modules are mounted on the underside of an outer frame. For the folding of the upper workpiece about the outer edges of the upper sword, folding modules are provided on the upper side of the outer frame. The swords are mounted on a common carriage and movable in height relative to each other. The carriage iself is likewise displaceable in height.

9 Claims, 11 Drawing Sheets

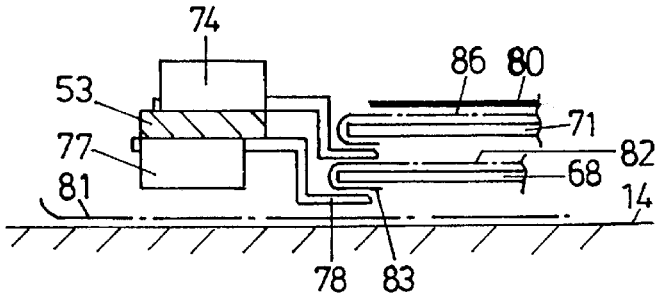
FIG. 12
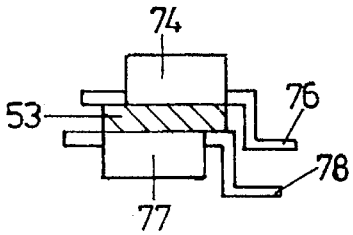
FIG. 13
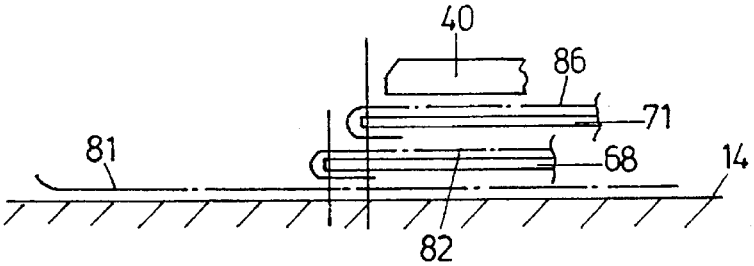
FIG. 15
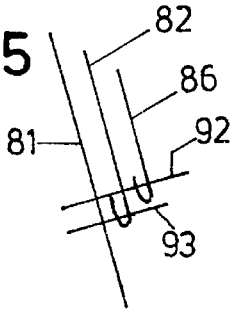
FIG. 14
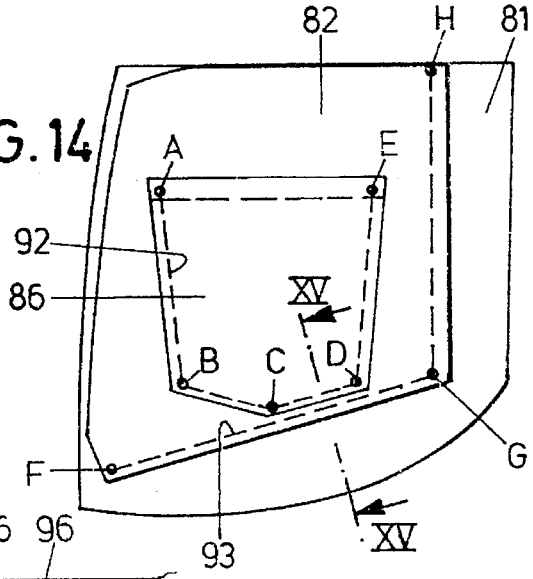
FIG. 16
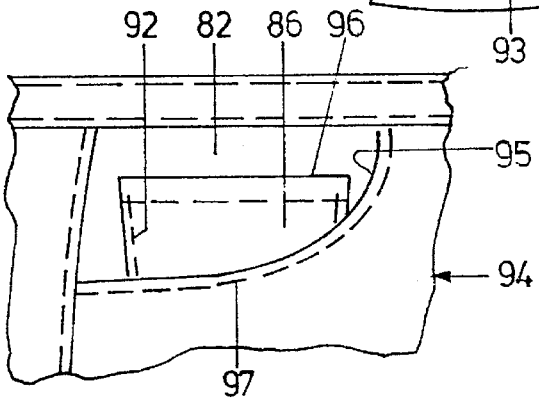

FIG. 18
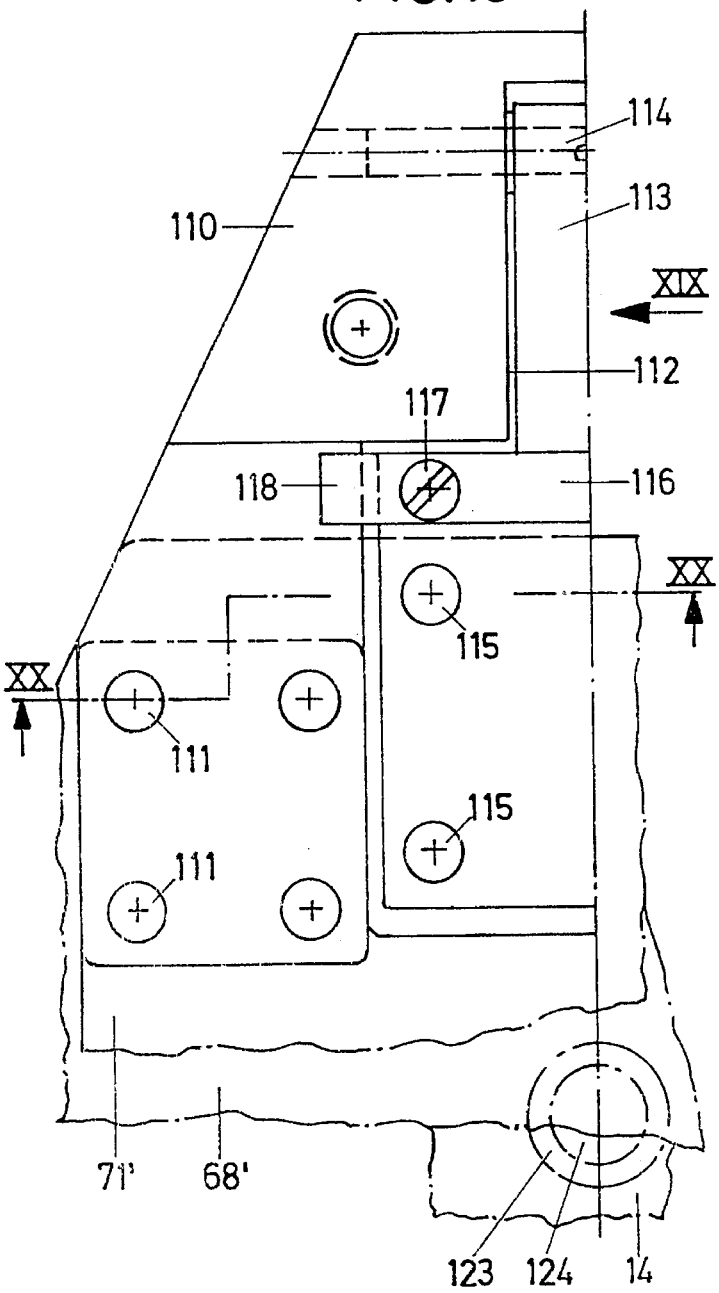
FIG. 19
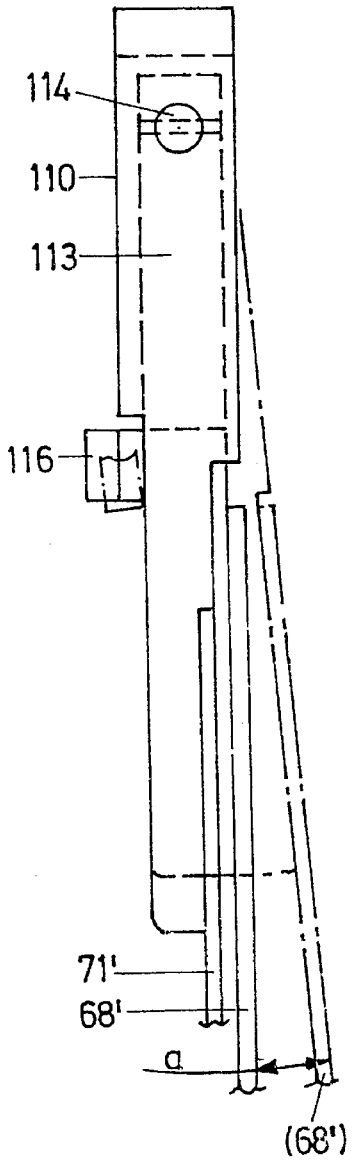
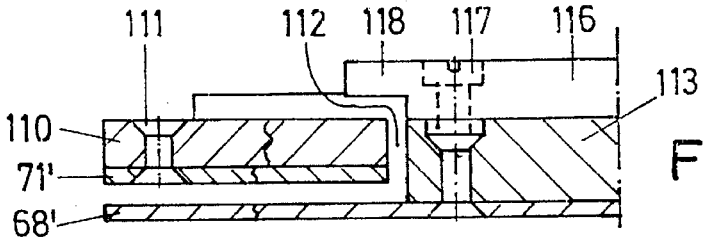
FIG. 20

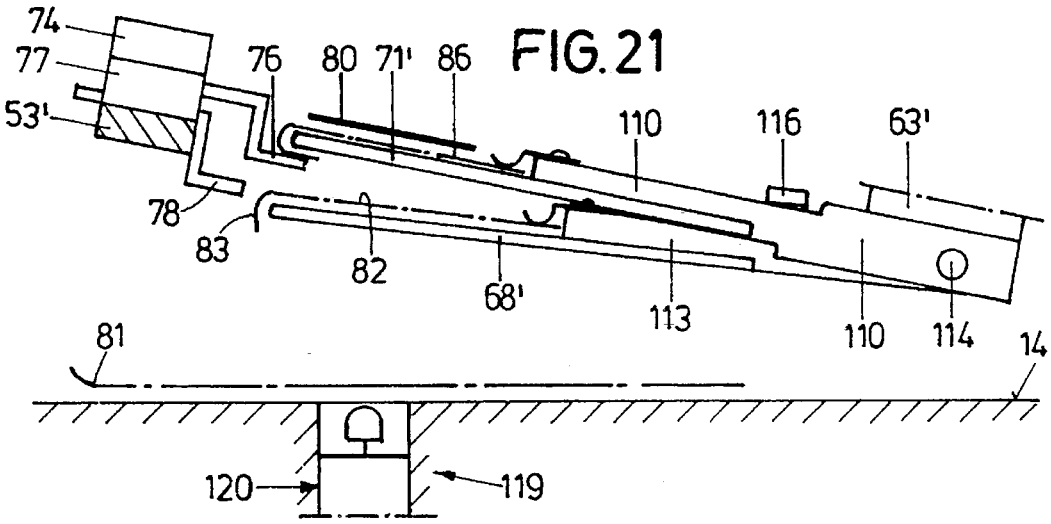
FIG. 21
FIG. 22
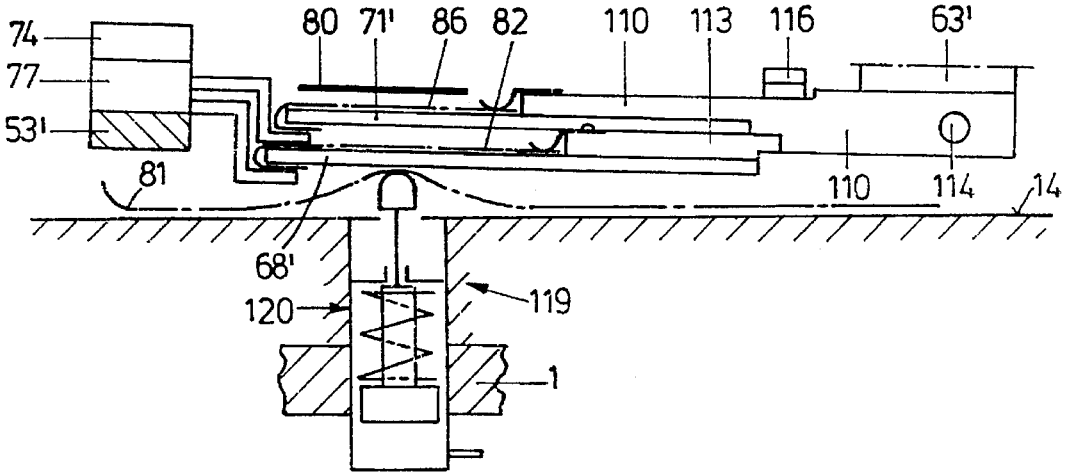
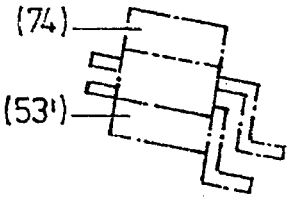
FIG. 23
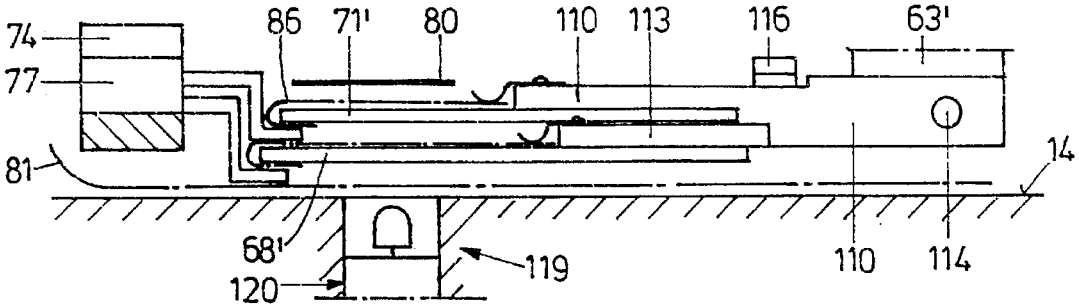

FOLDING DEVICE FOR AN AUTOMATIC SEWING MACHINE

BACKGROUND OF THE INVENTION

1. Field of the Invention

The invention relates to a folding device for an automatic sewing machine, which comprises a workpiece-receiving plate for a lower workpiece; an upper sword, mounted on a sword support, for receiving an upper workpiece; and an outer frame mounted on an outer-frame support and having folding modules for folding the upper workpiece about outer edges of the upper sword; the upper sword being movable, by the motion of its sword support, between a lower working position adjacent to the workpiece-receiving plate and an upper working position above the workpiece-receiving plate; and the outer frame being movable, by the motion of its support, into a lower working position adjacent to the workpiece-receiving plate and at least into a working position that corresponds to the upper working position of the upper sword; and the upper sword being movable from its working position into a retracted position in which it is with drawn from the upper workpiece.

2. Background Art

In a folding device of the generic type known from U.S. Pat. No. 4,819,572, a pocket cut is placed as an upper workpiece on the upper sword. Then the marginal portions of the pocket cut are folded about the outer edges of the sword by means of folding modules. Then the sword provided with the folded pocket cut is lowered onto the lower workpiece, for instance a trouser piece located on the carrier plate, and the sword is withdrawn. The folding strips of the folding modules are withdrawn too, and the outer frame is moved upwards.

A folding device of this type ensures that even comparatively small pockets, so-called watch pockets, can be placed on a cut to be pieced on, with which they will then be sewn. The sewing of the to-be-pieced-on cut onto pocketing material will take place subsequently at a standard sewing-workplace.

SUMMARY OF THE INVENTION

It is the object of the invention to embody a folding device for automatic sewing machines, by means of which an upper workpiece is folded, placed on an intermediate workpiece that is also to be folded, and can be placed, together with the latter, on a lower workpiece for all the three workpieces to be sewn together in common.

According to the invention, this object is attained in a folding device of the generic type by the features consisting in that a lower sword for receiving an intermediate workpiece is disposed between the upper sword and the workpiece-receiving plate, and is movable into a lower working position on the workpiece-receiving plate and an upper working position above the workpiece-receiving plate and under the upper sword; in that the lower sword is movable into a retracted position in which it is withdrawn from the intermediate workpiece; in that the upper sword and the lower sword are movable relative to each other into a position adjacent to each other and into a position spaced from each other; and in that folding modules allocated to the lower sword are mounted on the outer frame. The measures according to the invention ensure that the lower workpiece can be placed on the workpiece-receiving plate, the intermediate workpiece on the lower sword, and the upper workpiece on the upper sword, the swords being in their upper working position and spaced from each other. Then the marginal portions of the upper and the intermediate workpiece are folded about the respective outer edges of the upper and the lower sword and both swords, with the workpieces lying on each other, are lowered onto the lower workpiece. Then both swords are withdrawn from the respective workpiece.

Further details of the invention will become apparent from the ensuing description of two exemplary embodiments, taken in conjunction with the drawing.

BRIEF DESCRIPTION OF THE DRAWING

FIGS. 9 through 13 are a diagrammatic illustration of the operating sequence of the folding device during the folding of workpieces;

FIG. 14 is a plan view illustrating the sewing of folded workpieces;

FIG. 15 is a partial section through the workpieces according to the line XV—XV of FIG. 14;

FIG. 16 is a partial illustration of a pair of jeans;

FIG. 18 is a partial plan view of the folding device according to the arrow XVIII of FIG. 17, with only one half being shown because of the symmetry;

FIG. 19 is a lateral view according to the arrow XIX of FIG. 18;

FIG. 20 is a section through FIG. 18 along the line XX—XX of FIG. 18; and FIGS. 21 through 23 are a diagrammatic illustration of the operating sequence of the second embodiment of a folding device during the folding of workpieces.

DESCRIPTION OF THE PREFERRED EMBODIMENTS

Figure 1:
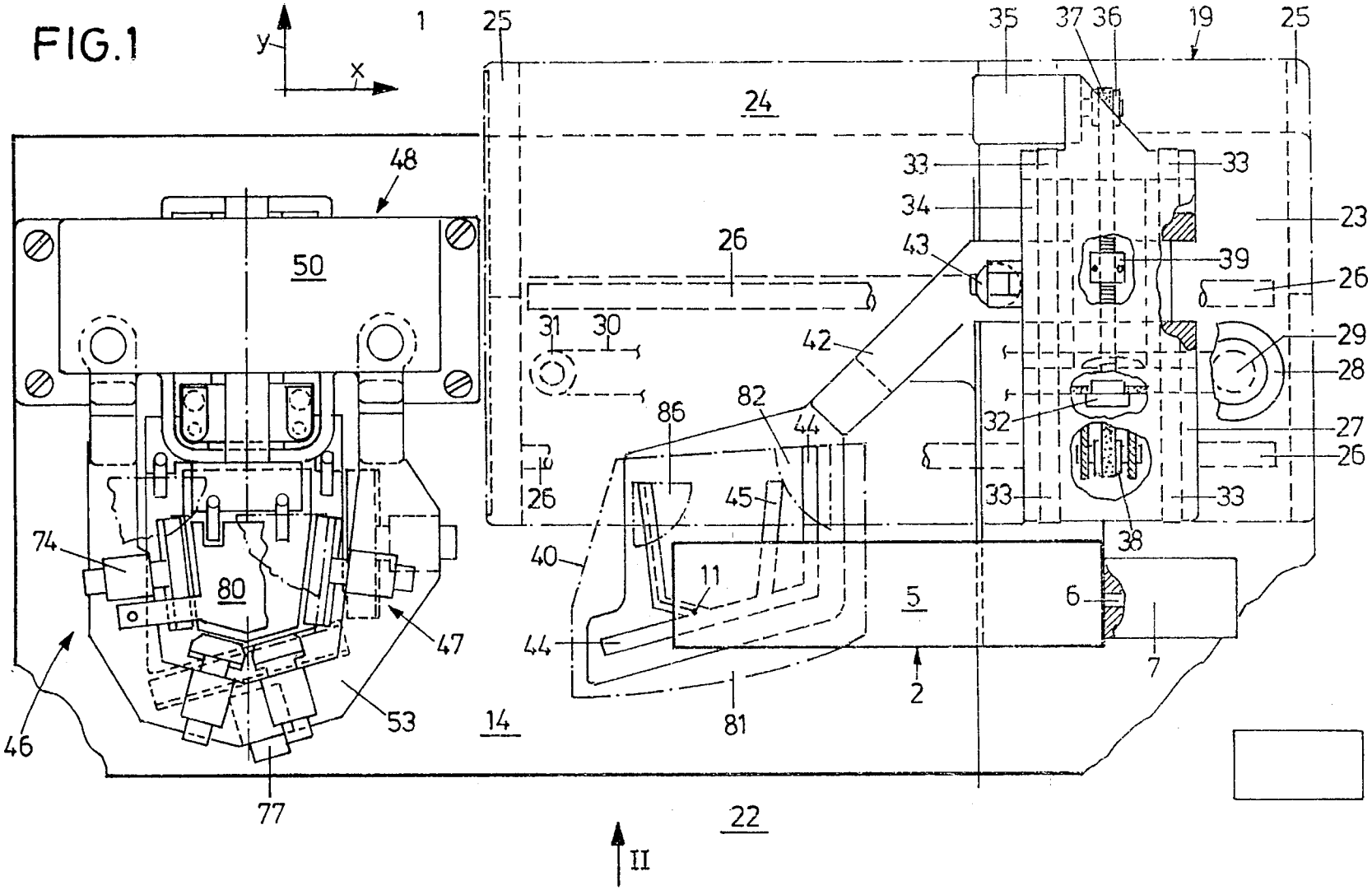
FIG. 1 is a plan view, partially broken away, of an automatic sewing machine.
Figure 2:
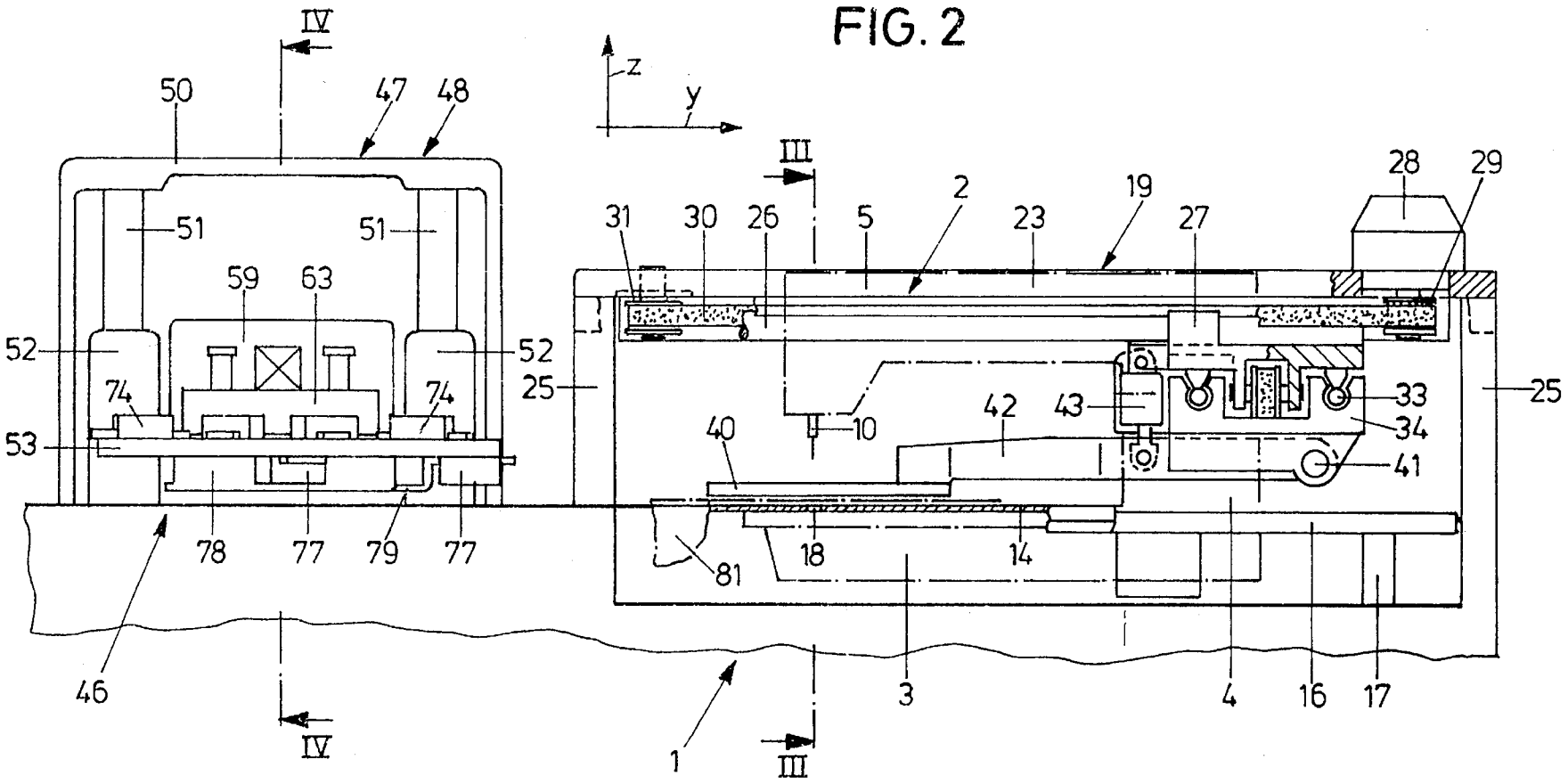
FIG. 2 is a front view, also partially broken away, of the automatic sewing machine according to the arrow II of FIG. 1.
Figure 3:
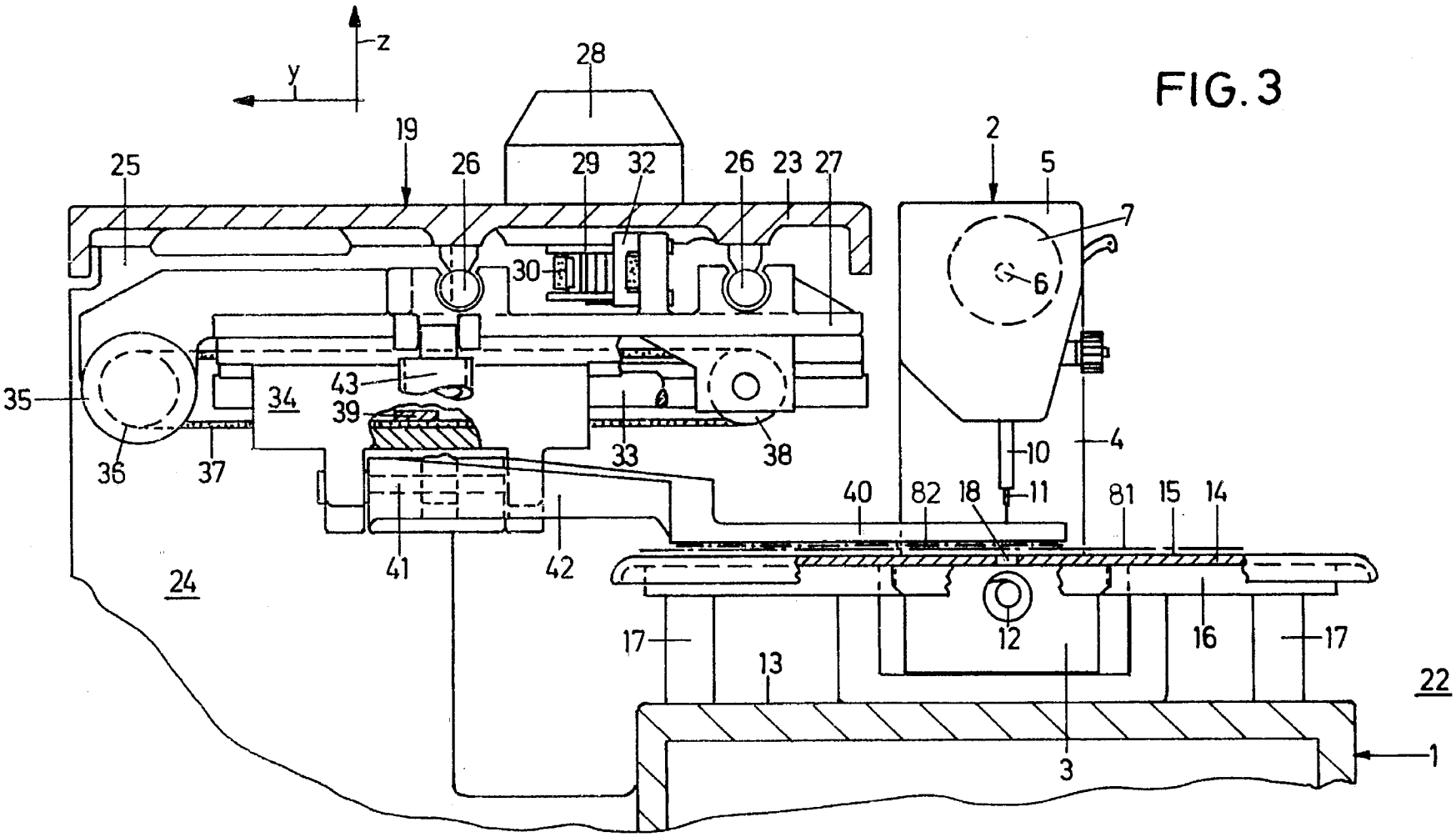
FIG. 3 is a vertical partial section through the automatic sewing machine according to the line III—III of FIG. 2.
Figure 5:
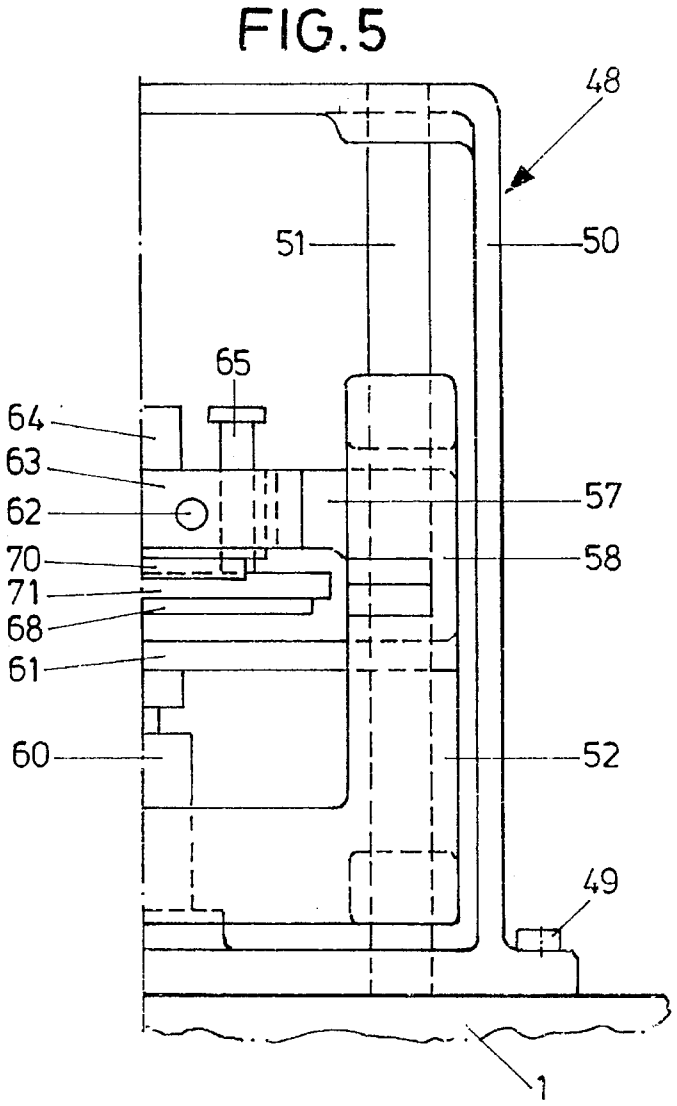
FIG. 5 is a front view of the folding device according to the arrow V of FIG. 4, with only one half being illustrated owing to the symmetry of the folding device.

The automatic sewing machine shown in FIGS. 1 to 3 has a stand 1 on which a sewing head 2 is mounted stationarily. It consists in the usual manner of a base plate 3, a standard 4 and an upper arm 5. Mounted conventionally in the arm 5 of the sewing head 2 is an arm shaft 6 which can be driven by an electric sewing machine drive motor 7. The drive of a needle bar 10 with a needle 11 and, in addition, the drive of a hook 12 situated in the base plate 3 are derived in the conventional manner from the arm shaft 6.

Arranged above the upper surface 13 of the stand 1, on the latter, is a workpiece-receiving plate 14, the upper side of which defines a sewing plane 15. This workpiece-receiving plate 14 is supported—at least partially—on a supporting plate 16 which is supported on the stand 1 by way of supports 17. This workpiece-receiving plate 14 is also supported on the base plate 3 of the sewing head 2 and has, in the path of movement of the needle bar 10 and needle 11 which is defined as the z direction, a stitch hole 18 permitting the passage of the needle 11 to the hook 12.

Above the workpiece-receiving plate 14, there is provided a guiding device 19 for workpiece cuts which are to be sewn together. This device is—as seen from the operator's side 22—arranged behind the sewing head 2. It has an upper base plate 23 which is supported behind the work-piece-receiving plate 14 on the stand I by way of vertical supporting walls 25 in the rearward area 24 of the stand 1 opposite to the operator's side 22—as seen from the operator's side 22. Attached to the underside of this base plate 23 are guide rods 26 which run parallel to one another in the x direction and on which a carriage 27 is arranged so as to be slidable in the x direction. This carriage 27 is driven by an electric motor 28, which in this case can be a geared motor, via a timing belt pulley 29 and an endless timing belt 30. The motor 28, together with the timing belt pulley 29, is supported on the base plate 23. The guide roller 31 is likewise mounted in the base plate 23. The timing belt 30, which is arranged between the guide rods 26 below the base plate 23, is connected to the carriage 27 by means of a securing device 32.

Attached to the underside of the carriage 27, which is designated as the x carriage, is a further pair of guide rods 33 which extend in the y direction, i.e. perpendicular to the x direction and parallel to one another and on which a further carriage 34 is slidably guided in the y direction. This carriage 34 is therefore designated as the y carriage. Both carriages 27, 34 are therefore guided so as to be suspended from the respective guide rods 26 and guide rods 33. The drive of the y carriage is provided via an electric motor 35, which, if necessary, is likewise in the form of a geared motor and is mounted on the x carriage in the rearward area 24. It has a timing belt pulley 36 by which the y carriage is driven via an endless timing belt 37. The timing belt 37 is guided via a guide roller 38 mounted on the underside of the y carriage and is attached to the underside of the y carriage 34 by means of a securing device 39. The x direction and y direction run perpendicular to one another and to the z direction. The x, y and z directions thus form a normal cartesian coordinate system. The x and y directions run parallel to the sewing plane 15. The x direction is parallel to the main longitudinal direction of the sewing head, i.e. parallel to the arm shaft 6.

A workpiece holder 40 is mounted on the underside of the y carriage 34 about a pivot axis 41 running parallel to the y direction. For this purpose, the workpiece holder 40 is attached to the end of an angle lever 42, the other end of which is mounted on the pivot axis 41. As shown in FIG. 1 and 3, the angle lever 42 is bent twice, i.e. firstly away from the workpiece holder 40 in the y direction towards the rearward area 24 and, secondly, upwards in the z direction from the workpiece receiving plate 14 to the underside of the y carriage 34. Between the pivot axis 41 and the workpiece holder 40, there is provided a lift and press drive 43 which, on the one hand, engages on the angle lever 42 and, on the other hand, engages on the y carriage 34. In this case the drive is a linear drive which is designed conventionally in the form of a pneumatically actuatable piston-cylinder drive. It follows from the preceding that the entire guiding device 19 with all the associated components is arranged above the workpiece-receiving plate 14, i.e. it can be arranged very close to the sewing head 2.

The workpiece holder 40 has two slots 44, 45 corresponding to the path of the seam 45 to be produced, with the aid of which the workpiece cuts are to be sewn together.

A preparatory station 46, in which to move the workpieces into the position necessary for the sewing job, is allocated to the sewing head 2 and the guiding device 19. The preparatory station 46 has a folding device 47. In the rearward area 24, provision is made for a bearing unit 48 of the folding device 47, which has a standard 50 fastened by screws 49 to the stand 1. The standard 50 has the shape of a housing open towards the operator's side 22. Guide columns 51 are supported in the standard 50, extending at a distance from and parallel to each other in the z direction, i.e. vertically, and disposed one beside the other in the x direction.

Figure 4:
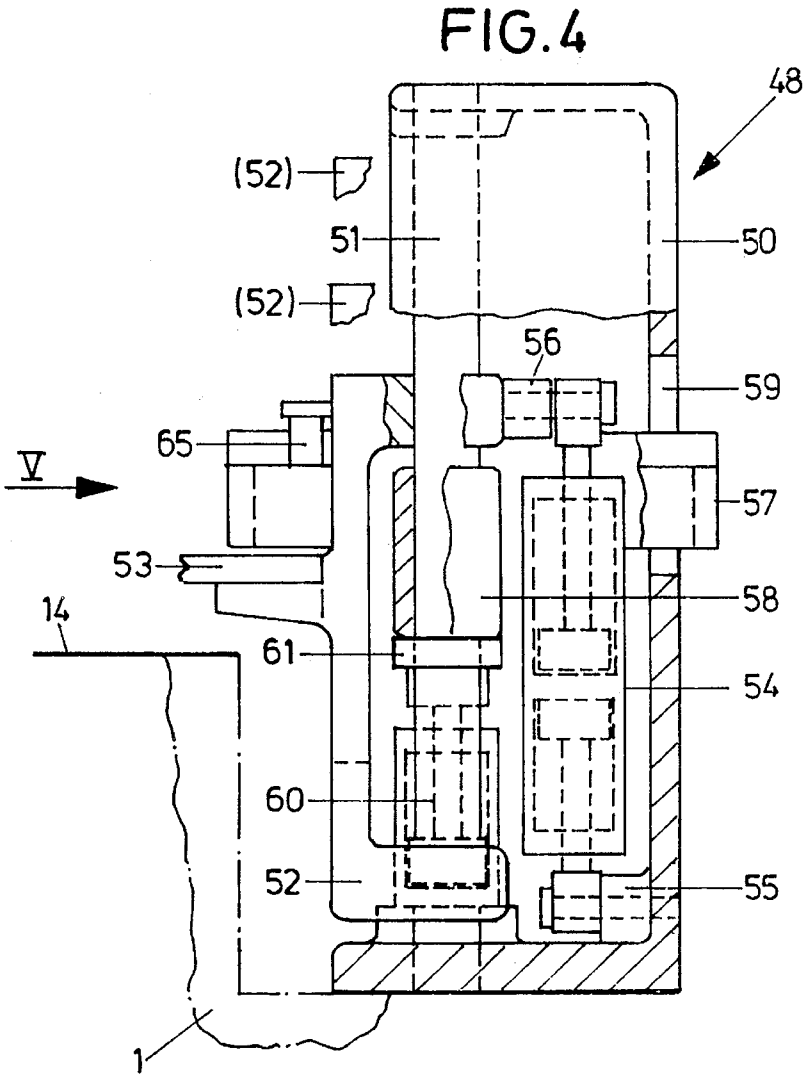
FIG. 4 is a partial section through a folding device according to the line IV—IV of FIG. 2.

A frame-type slide bearing 52 is positioned on the guide columns 51 for displacement in the z direction. The slide bearing 52 supports an outer frame 53 which is disposed horizontally and extends from the standard 50 in the direction towards the operator's side 22. Two multiposition linear drives 54 engage on the slide bearing 52, which are in the form of piston-cylinder drives and disposed symmetrically to each other behind the guide columns 51. Each linear drive 54 is articulated to a bearing 55 provided in the lower portion of the standard 50 on the one hand, and to a bearing 56 joined to the slide bearing 52 on the other. By these linear drives 54 being triggered correspondingly, the slide bearing 52 with the outer frame 53 can be displaced to take a lower, an intermediate and an upper position, as seen in FIG. 4.

Further, a bearing frame 57 is guided on the two guide columns 51 for displacement by means of slide bearings 58. The bearing frame 57 projects through a rearward opening 59 of the standard 50. The bearing frame 57 is displaceable between a lower and an upper position by means of a two-position linear drive 60. This linear drive 60 is likewise a piston-cylinder drive supporting itself on the underside of the standard 50 on the one hand and on a plate 61 on the other, this plate 61 being disposed on the underside of the slide bearings 58 and interconnecting the latter.

Two guide rods 62 extending in the y direction, i.e. horizontally, and spaced apart in the x direction are mounted on the bearing frame 57. A carriage 63 serving as a bracket is displaceably disposed on these guide rods 62, this carriage 63 being displaceable in the y direction between a front position turned towards the operator's side 22 and a rearward position by means of a linear drive 64 in the form of a piston-cylinder drive without a piston rod. The rearward position of the carriage 63 is roughly outlined by a dot-dashed part of FIG. 7.

Figure 6:
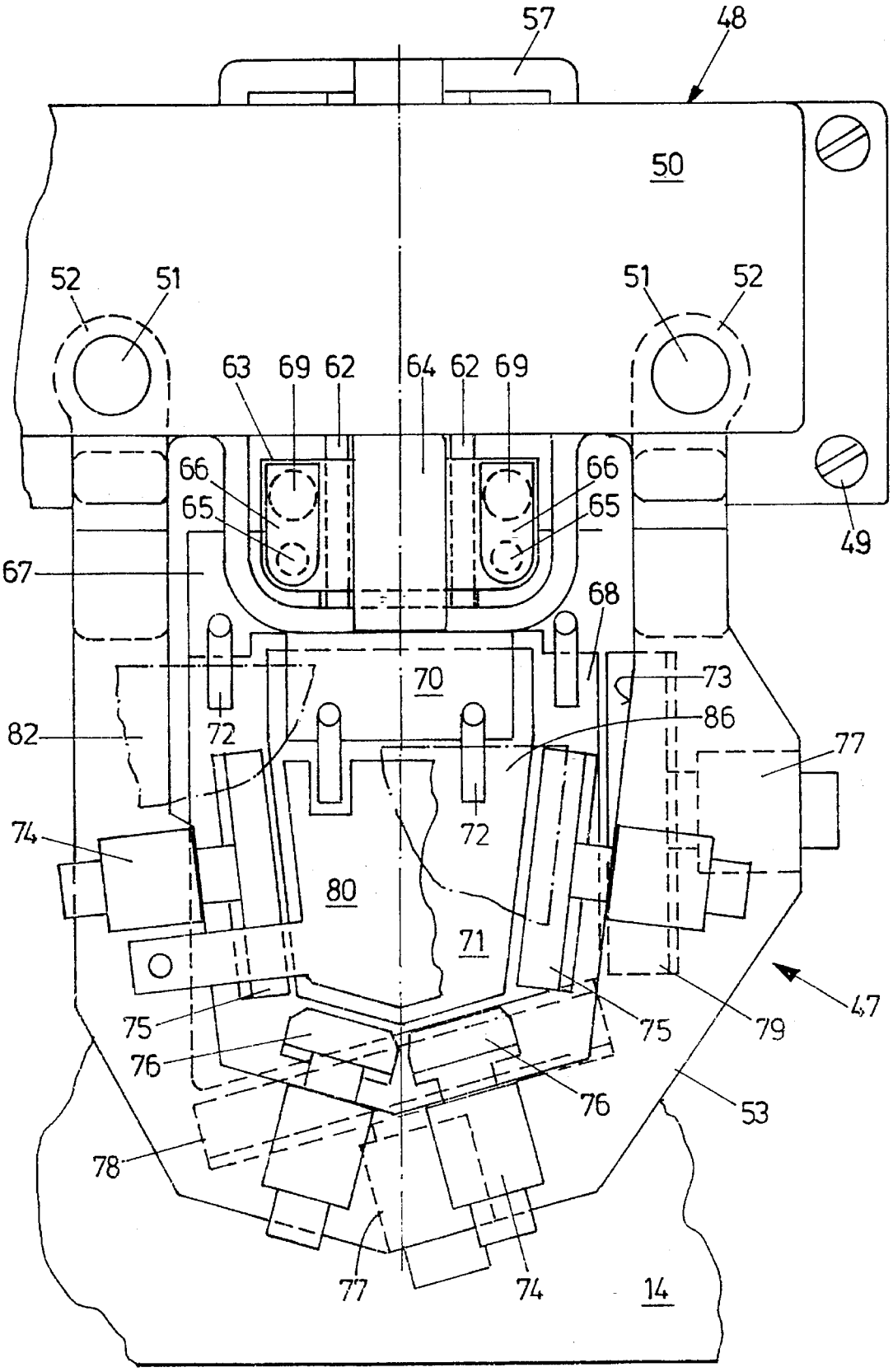
FIG. 6 is a plan view, partially broken away, of the folding device on an enlarged scale as opposed to FIG. 1.
Figure 7:
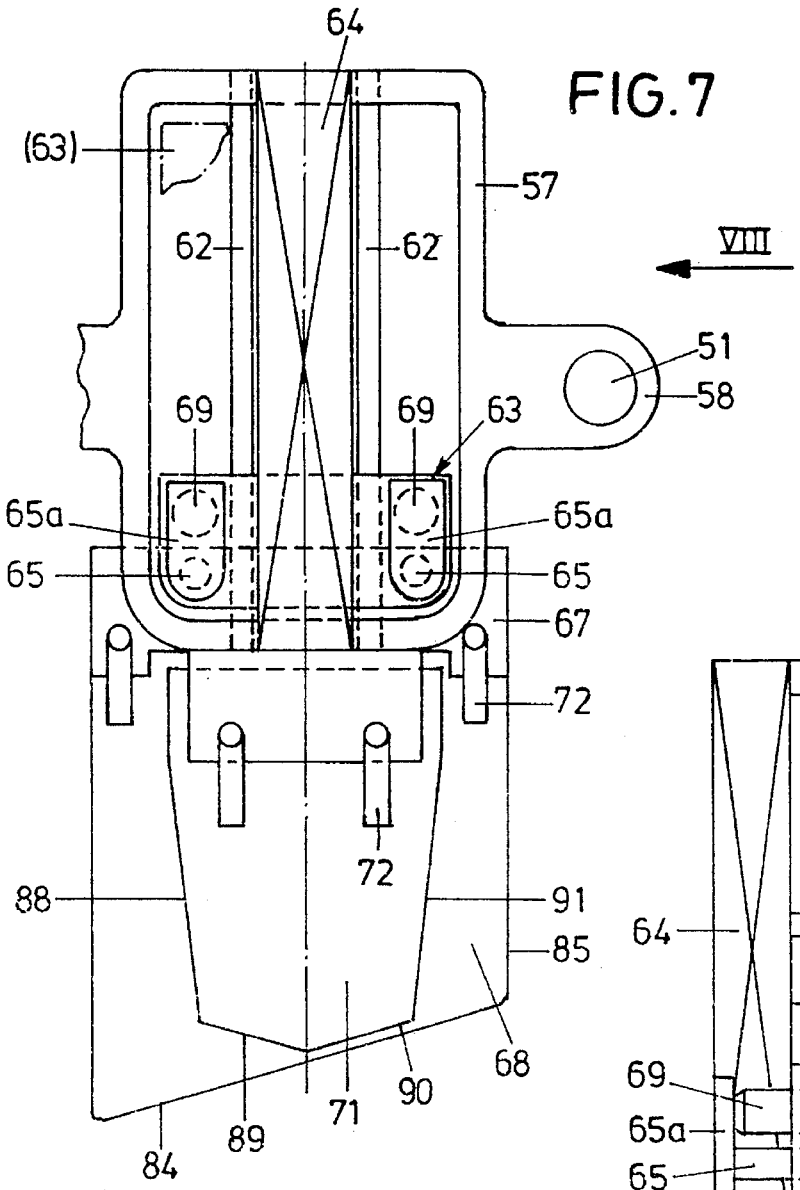
FIG. 7 is a plan view of a bearing frame with swords.
Figure 8:
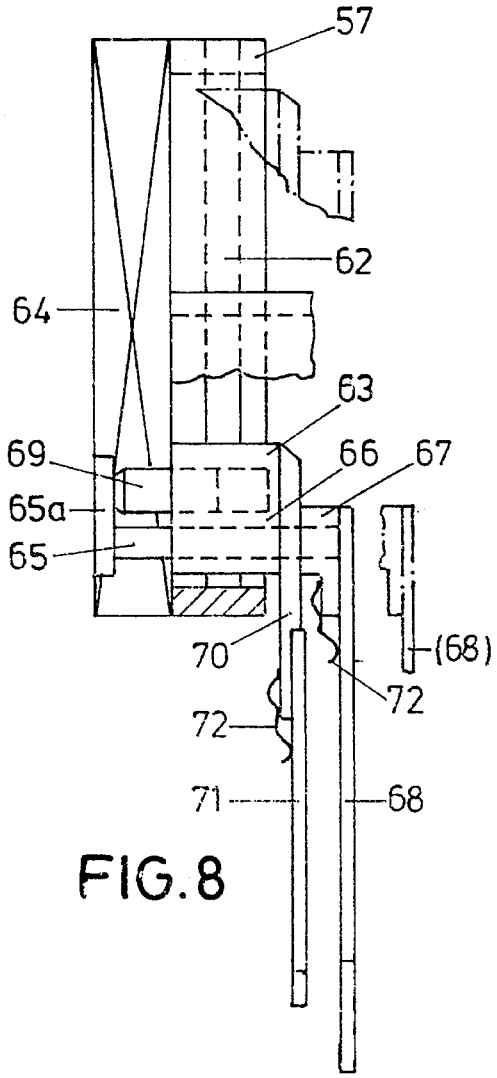
FIG. 8 is a lateral view of the bearing frame with swords according to the arrow VIII of FIG. 7.

On the carriage 63, guide rods 65 displaceable in the z direction, i.e. vertically, are run in bearings 66 to which is fastened a mounting 67 for a lower sword 68. Two linear drives 69 in the form of piston-cylinder drives are disposed between the carriage 63 and an upper transverse head **65*a* of the guide rods 65, the lower sword 68 being displaceable, by means of these drives 69, relative to the bearing frame 57 between an upper position—shown by solid lines in FIG. 8—and a lower position—roughly outlined by dot-dashes in FIG. 8. On the underside of the carriage 63 above the lower sword 68, provision is made for a mounting 70 to which is fastened an upper sword 71, which will therefore always be situated above the lower sword 68. As seen in FIGS. 6 and 7, the upper sword 71 is smaller than the lower sword 68. Workpiece clamps 72 are mounted on both swords 68, 71**.

According to FIG. 6, the outer frame 53 is about U-shaped, having an opening 73. Four folding modules 74 are mounted on the upper side of the outer frame 53, each having a folding bar 75 or 76, respectively, and being allocated to the upper sword 71. Two folding modules 77 are mounted on the underside of the outer frame 53, each having a folding bar 78 or 79, respectively, and being allocated to the lower sword 68. Folding modules 74 and 77 of this type are generally known. They are pneumatically actuated piston-cylinder drives, by means of which the folding bars 75, 76 and 78, 79, respectively, can be displaced relative to the upper sword 71 or lower sword 68. The opening 73 extends at a distance around the spade-type upper sword 71 (FIGS. 1 and 6). The distance is dimensioned in order for the folding bars 75 and 76 to be received therein unimpeded. On the outer frame 53, a pressing plate 80 is mounted, which is elastically positionable in the z direction and which partially covers the upper sword 71.

The operation of the folding device 47 is explained in the following, in particular taken in conjunction with FIGS. 9 to 12.

Figure 9:
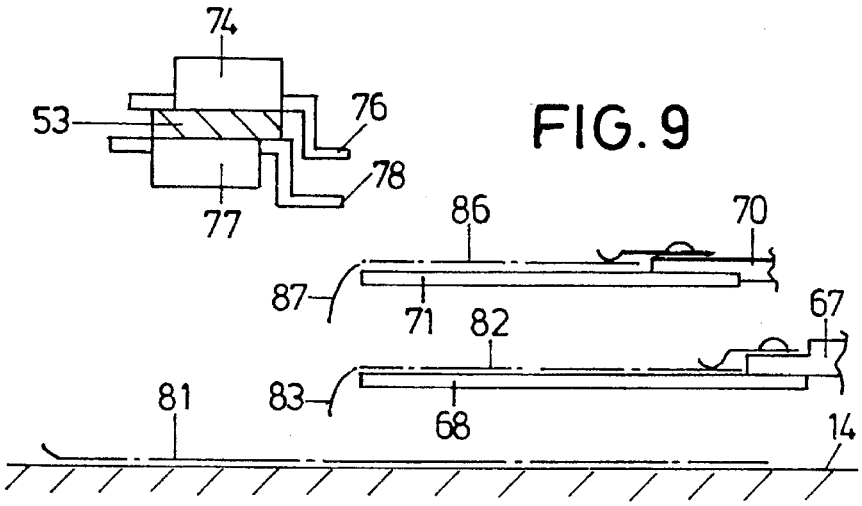

In the starting position, the outer frame 53 on the one hand and the bearing frame 57 on the other are in their upper position. The lower sword 68 is in its lower position relative to the carriage 63; in this position, it is still at a distance from the workpiece-receiving plate 14. This starting position is shown in FIG. 9. The bearing frame 57 is in its position moved out of the standard 50 towards the operator's side 22. The operator places a first workpiece cut 81—of a lining material for a pocket of a pair of jeans in this embodiment—on the workpiece-receiving plate 14. The workpiece-receiving plate 14 is provided with marks which are for instance glued on, ensuring as precisely as possible an alignment of the first workpiece 81 relative to the swords 68, 71. Then a second workpiece 82 is placed on the lower sword 68 and slipped under the workpiece clamps 72 so that it is retained on the sword 68. In the present embodiment, this second workpiece 82 is a to-be-pieced-on cut from the actual trouser material. Its marginal portions 83 project over the outer edges 84, 85 of the lower sword 68, about which they are to be folded. A third workpiece 86 is placed on the upper sword 71, this workpiece 86 being a small pocket cut, for instance a watch pocket, which, in the condition sewn on, has a width of about 8 cm at maximum. It is likewise retained under the workpiece clamps 72. Its marginal portions 87 project over the outer edges 88, 89, 90, 91 of the upper sword 71, about which they are to be folded. Parts of the second and third workpieces 82 and 86 placed on the swords 68, 71 are roughly outlined by dot-dashed lines in FIG. 6.

Figure 10:
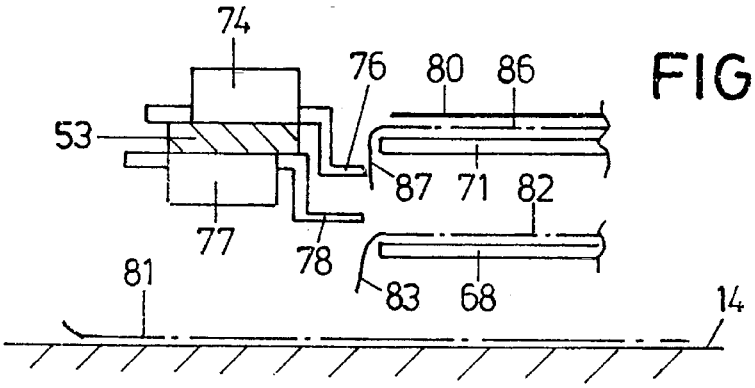

Then the outer frame 53 is lowered into its intermediate position. The bearing frame 57 comprising the swords 68, 71 remains unchanged in its position according to FIG. 9. This lowered position of the outer frame is seen in FIG. 10. The folding bars 75, 76 of the folding modules 74 mounted on the upper side of the outer frame 53 are now in a position directly below the upper sword 71—as seen in FIG. 10—i.e. they are in their position retracted towards the folding modules 77. The pressing plate 80 rests on the third workpiece cut 86, pressing it on the upper sword 71.

Figure 11:
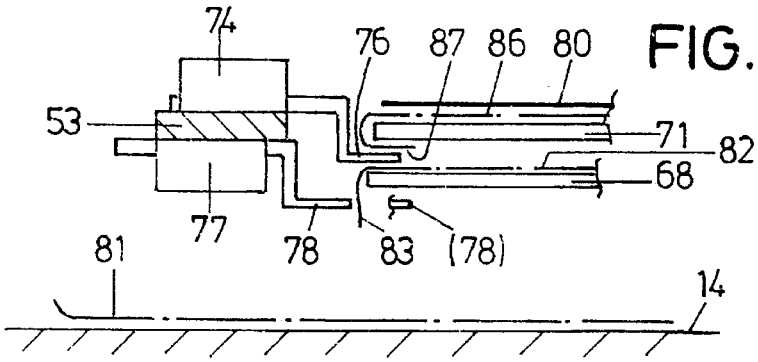

As can be taken from FIG. 11, the four folding modules 74 are now actuated in such a way that the four folding bars 75, 76 are slipped under the upper sword 71 in a direction normal to the extension of the outer edges 88 to 91. They take along the marginal portions 87 of the third workpiece 86 and fold same about the outer edges 88 to 91 of the upper sword 71. Then the linear drives 69 are actuated in such a way that the lower sword 68 is moved against the underside of the upper sword 71, while the position of the outer frame 53 and the bearing frame 57 remains unchanged. Then the folding modules 77 disposed on the underside of the outer frame 53 are actuated—as seen in FIG. 12—for the folding bars 78, 79 to fold the marginal portion 83 of the second workpiece 82 about the outer edges 84, 85 of the lower sword 68.

Then the outer frame 53 is moved downwards from its intermediate position and the bearing frame 57 is moved downwards from its upper position so that the unit of the upper sword 71, the lower sword 68 and the folded workpieces 82, 86 lies on the first workpiece 81 on the workpiece-receiving plate 14, which can be seen in FIG. 12.

Subsequently, the folding modules 74 and 77 are acutated in such a way that the folding bars 75, 76 and 78, 79 are withdrawn from under the swords 68, 71. The marginal portions 83 and 87 of the workpiece cuts 82 and 86 remain in their folded position, as seen in FIG. 13. Then the outer frame 53 is moved from its lowermost position into its uppermost position, as roughly outlined in FIG. 13.

By the x carriage 27 and the y carriage 34 being driven correspondingly, the workpiece holder 40 serving as a transfer plate is moved under the lifted outer frame 53 and over the unit of the swords 68, 71 and the workpieces 81, 82, 86. During this operation, the workpiece holder 40 is in a position lifted from the workpiece-receiving plate 14, to which end the lift and press drive 43 is retracted. This drive 43 is now actuated to move downwards for the workpiece holder 40 to rest on the unit mentioned above. Then the linear drive 64 is actuated in such a way that the carriage 63 comprising the swords 68, 71 is displaced in a direction away from the operator's side 22 towards the rearward area 24. The swords 68, 71 are withdrawn from the folded workpieces 82, 86. The drive 43 being actuated, the workpiece holder 40 presses the three workpieces 81, 82, 86 on the workpiece-receiving plate 14. By the x carriage 27 and the y carriage 34 being correspondingly driven, the workpiece holder 40 is moved under the sewing head 2 where the sewing of the three workpieces 81, 82, 86 will start.

The marginal areas 83 and 87, respectively, of the second workpiece 82 and the third workpiece 86 are situated under the slots 44 and 45 of the workpiece holder 40. According to FIG. 14, the sewing job starts at a corner of the third workpiece 86 from the point A. By corresponding actuation of the x carriage 27 and the y carriage 34, a seam 92 is produced along the marginal portion of the third workpiece 86 from the point A via points B, C, D to a point E. This seam 92 is sewn through all the three workpieces 81, 82, 86. This sewing job is performed along the slot 45 in the workpiece holder 40, i.e. the watch pocket forming the third workpiece 86 is sewn on. Then the needle is stopped at the point E and a thread cutting operation takes place. At the points A and E the seam is sewn up as usually.

Then the workpiece holder 40 together with the workpieces 81, 82, 86 is displaced in such a way that the slot 44 takes its place under the needle 11 so that a seam 93 can be started at the point F to be continued via the point G as far as to the point H. Here, too, the seam is sewn up at the points F and H, which is followed by a thread cutting operation. The sewing job is finished. Once the seam 93 has been produced, the first and the second workpiece 81 and 82, i.e. the lining material and the cut to be pieced on, are sewn together.

FIG. 16 illustrates how the entire piece consisting of the three workpieces 81, 82, 86 is incorporated in a pair of jeans 94. The second workpiece 82, i.e. the cut to be pieced on, forms the visible portion of a pocket opening 95. The upper opening 96 of the watch pocket, which is formed by the third workpiece 86 combining with the second workpiece 82, is situated within the pocket opening 95. The first workpiece 81 constitutes the pocketing of a pocket 97, which is not to be seen in FIG. 16.

To facilitate the positioning of the second workpiece 82 and the third workpiece 86 on the swords 68 and 71, the outer frame 53 can be movable from the position adjacent to the operator's side 22 into a position retracted towards the rearward area 24, as is known from U.S. Pat. No. 4,819,572. The outer frame 53 and the bearing frame 57 can be pivotable in height about a horizontal axis running in the x direction—as known from the publication mentioned above.

The embodiment of FIGS. 17 to 20, the working of which will be explained taken in conjunction with FIGS. 21 to 23, differs from the first embodiment specified above substantially in that the swords are disposed to be pivotable about a pivot bearing and that the drive moving the lower sword is not disposed on a carriage for the swords, but in the workpiece receiving plate. As far as identical components are used, they will have the same reference numerals. As far as components are used that are identical functionally, but differ in construction, they will have the same reference numerals as in the first embodiment, however provided with a prime. In these cases there is no need of renewed detailed specification.

The basic structure of the preparatory station 46' comprising the folding device 47' is known from U.S. Pat. 4,819,572 mentioned at the outset, to which reference is made in as much as details are concerned that of no relevance hereto. The folding device 47' has a cover-type outer-frame support arm 101, which is disposed above the workpiece-receiving plate 14, projecting over the latter partially at the rearward area 24 opposite to the operator's side 22. On its rearward end, the outer-frame support arm 101 comprises a lever arm 102 which extends downwards. The outer-frame support arm 101 is supported in the area of transition to the lever arm 102 to be pivoted about a pivot axis 103 which extends in the x direction and is retained in the bearing arms 104 that are mounted on the rear of the stand 1 and project upwardly from the latter towards the rearward area 24. An outer-frame-pivoting drive engages on the lower end (not shown) of the lever arm 102, which is a pneumatically actuated three-position piston-cylinder drive to be positioned in an intermediate position in addition to two final positions, as a result of which the outer-frame support arm 101 and thus the outer frame 53' supported by the latter can be positioned to take three different pivoted positions. In this embodiment, it is not only the folding modules 74 that are mounted on the upper side of the outer frame 53', but also the folding modules 77.

In the outer-frame support arm 101, provision is made for parallel guide rods 105 which extend at right angles to the x direction and on which the outer frame 53' is displaceably guided by means of a slide bearing 106 taking the function of an outer-frame support. In the position according to FIG. 17, in which the outer-frame support arm 101 is pivoted upwards, the guide rods 105 run about parallel to to the workpiece receiving plate 14 in the y direction. Above and between the guide rods 105, an outer-flame-displacing drive 107 is disposed in the outer-frame support arm 101, engaging on the slide bearings 106. The outer frame 53' can take a final position—on the right of FIG. 7—in which it is largely retracted into the outer-frame support arm 101 and in which is denoted by (53') in FIG. 17. The upper final position—on the left of FIG. 17—in which it is extracted from the outer-frame support arm 101, is shown in solid lines.

A sword support arm 108 is likewise pivotably supported on the pivot axis 103 and is disposed substantially under the outer-frame support arm 101 and in particular under the guide rods 105 comprising the slide bearings 106. On the rear end of this sword support arm 108, provision is made for an arm 109 extending downwards, which is disposed substantially within the lever arm 102. A sword-pivoting drive (not shown) engages on the lower end of this arm 109, by means of which the sword support arm 108 can be pivoted about the pivot axis 103. Two guide rods 62' are disposed in the sword-support arm 108, with a carriage 63' having the job of a sword support being displaceably supported on them. The carriage 63' is provided with a support plate 110 to which an upper sword 71' is fastened by means of rivets 111. The upper sword 71' is thus firmly joined to the carriage 63'. As seen in FIG. 18, the support plate 110 has a central recess 112, in which a pivoted lever 113 is disposed, which is supported to be pivoted about a bearing pin 114 disposed in the support plate 110 in the x direction. A lower sword 68' is fastened to the pivot lever 113 by rivets 115. A strip 116 is mounted by means of screws 117 on the pivot lever 113, the two ends of the strip 116 having stops 118 that project laterally in the x direction over the recess 112, i.e. overlap the support plate 110. These stops 118 are formed so as to rest on the support plate 110 when the pivoted lever 113, together with the lower sword 68', is pivoted downwards under gravity from the upper sword 71' by an angle a of about 5°. The lower sword 68' pivoted downwards relative to the upper sword 71' is shown by dot-dashes and denoted by (68') in FIG. 19. When the lower sword 68' and the upper sword 71' are in a position adjacent to each other, then the stops 118 are in a position above the support plate 110, as seen in FIG. 20.

As regards the drives (not shown) of the outer-frame support arm 101 and the sword support arm 108, reference is made—as mentioned above—to U.S. Pat. No. 4,819,572.

The folding modules 74 and 77 and their folding bars 75, 76 and 78, 79 and the sowrds 68' and 71' are embodied as specified and explained above.

An adjustable support bearing 119 is disposed in the workpiece receiving plate 14 underneath the lower sword 68' and comprises a pneumatically actuated piston-cylinder drive 120 of simple action, the cylinder 121 of which is fixed to the stand 1 underneath the workpiece-receiving plate 14 and on the piston rod 122 of which is mounted a support 124 displaceable through an opening 123 in the workpiece-receiving plate 14 upwards beyond the latter. A restoring spring 125 is disposed in the drive 120.

The operation of the folding device of the preparatory station 46 and thus of the folding device 47' is for the most similar to that of the first embodiment specified above. In the starting position, the outer-frame support arm 101 comprising the slide bearing 106 and the outer frame 53', and the sword support arm 108 comprising the carriage 63' and the upper sword 71' are in their upper position. The outer frame 53' is in its position retracted into the outer-frame support arm 101 mentioned above. The lower sword 68' is in a position pivoted, under the action of gravity, by an angle a relative to the upper sword 71', with the stops 118 resting on the support plate 110. The support bearing 119 is in its position displaced under the workpiece-receiving plate 14. The operator places a first workpiece 81 on the workpiece-receiving plate 14. Then a second workpiece 82 is placed on the lower sword 68'—as described above—and retained under the workpiece clamps 72. A third workpiece 86 is placed on the upper sword 71 and retained under the workpiece clamps 72.

Figure 17:
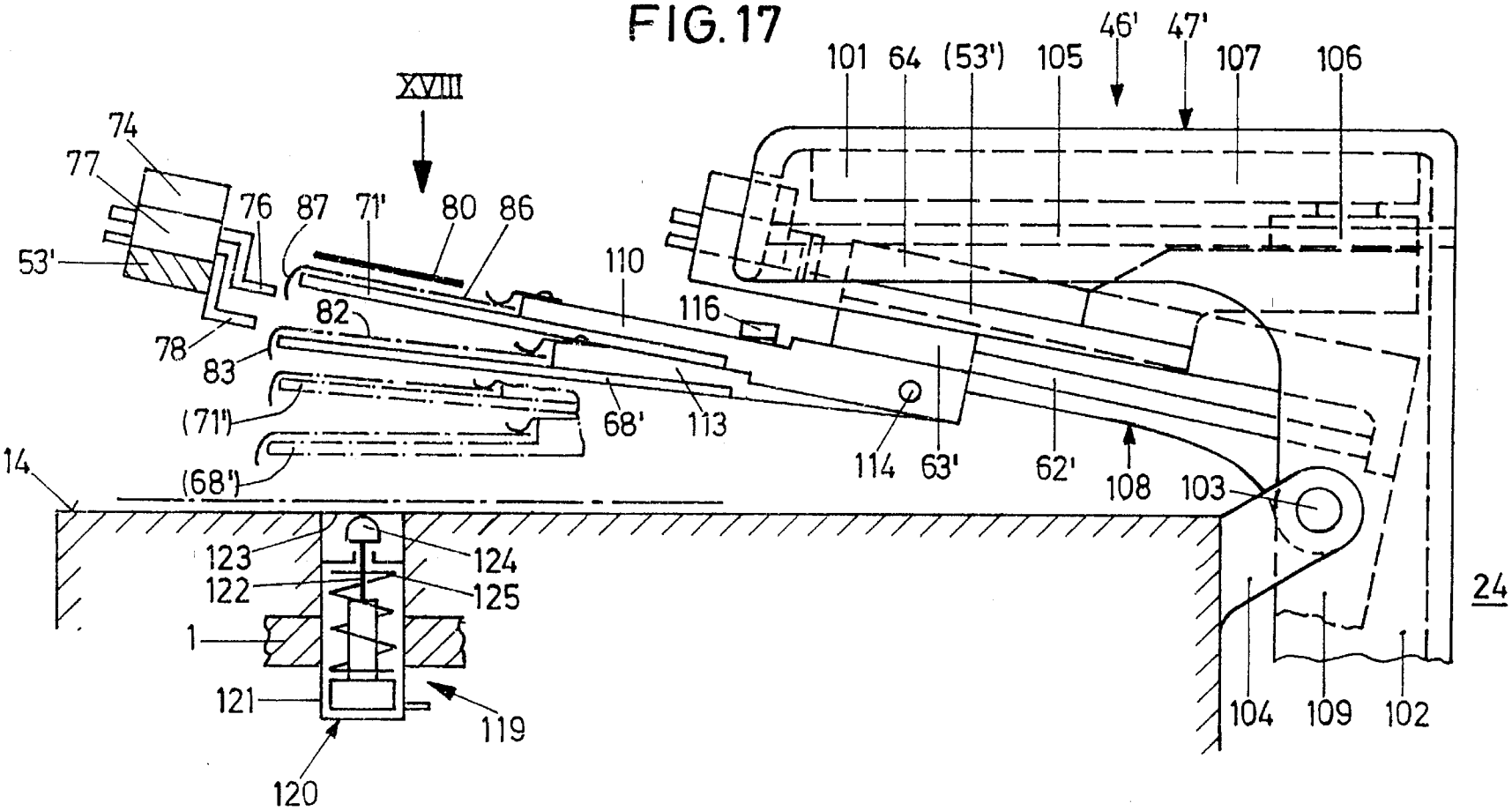
FIG. 17 is a lateral, diagrammatic view of a second embodiment of a folding device.

Subsequently, the outer frame 53' is moved into a position shown on the left in FIG. 17, in which it is extracted from the support arm 101. Simultaneously, the sword support arm 108 is lowered shortly so as to avoid any collision of the support plate 110 and the outer frame 110 that moves out of the support arm 101. The positions of the swords lowered for a short wile in the manner mentioned above are shown by dot-dashes in FIG. 17 and denoted by the references (71') and (68'). As soon as the outer frame 53' has taken its final position—on the left of FIG. 17—in which it is extracted from the support arm 101, the support arm 108 comprising the swords 71' and 68' is again pivoted upwards, the upper sword 71' with the upper third workpiece 86 thereby bearing against the pressing plate 80.

Then the folding bars 75, 76, of which only the folding bars 76 are shown, are moved out of the folding modules 74 so that the marginal portions 87 of the third workpiece 86 are folded about the outer edges 88 to 91 of the upper sword 71', as roughly outlined in FIG. 21. The drive 120 of the support bearing 119 is actuated in such a way that the support 124 is moved out of the opening 123 in the workpiece-receiving plate 14, thereby slightly lifting the first workpiece 14, as outlined in FIG. 22. Then the outer-frame support arm 101 comprising the outer frame 53', and the sword support arm 108 comprising the swords 68' and 71' are pivoted into an intermediate position—shown in FIG. 22—in which the lower sword 68' rests on the support bearing 119 and is moved towards the underside of the upper sword 71', thereby arriving at the folding bars 76 of the folding modules 74. Now the folding modules 77 are actuated for the associated folding bars 78, 79 to fold the marginal portions 83 about the outer edges 84 and 85 of the lower sword 68'. After this, with the folding bars 75, 76 and 78, 79 still extracted, the outer-frame support arm 101 comprising the outer frame 53', and the sword support arm 108 comprising the swords 68' and 71' is moved into the lower position, shown in FIG. 23, on the workpiece-receiving plate 14, in which the support 124 of the support bearing 119 is again moved through the opening 123 under the workpiece-receiving plate 14. Then the folding bars 75, 76 and 78, 79 are withdrawn from under the swords 68', 71' in the manner described above regarding FIG. 13, and the outer frame 5Y is moved into its position shown by dot-dashes in FIG. 23. As specified, the workpiece holder 40 is displaced into a position above the unit of the swords 68', 71' and the workpieces 81, 82, 83. By means of the linear drive 64, the carriage 63' is moved in a direction towards the rearward side, the swords 68', 71' thereby being withdrawn from the folded workpieces 82, 86 away from the operator's side 22 towards the rearward area 24. The rest of the operation takes place as specified above.

What is claimed is:

1. A folding device for an automatic sewing machine, comprising a workpiece-receiving plate (14) for a lower workpiece (81);

an upper sword (71, 71'), mounted on a sword support, for receiving an upper workpiece (86);

an outer frame (53, 53') mounted on an outer-frame support and having folding modules (74) for folding the upper workpiece (86) about outer edges (88 to 91) of the sword (71, 71');

the sword (71, 71') being movable, by the motion of the sword support, between a lower working position adjacent to the workpiece-receiving plate (14) and an upper working position above the workpiece-receiving plate (14); and the outer frame (53, 53') being movable, by the motion of its support, into a lower working position adjacent to the workpiece-receiving plate (14) and at least into a working position that corresponds to the upper working position of the sword (71, 71'); and the sword (71, 71') being movable from its working position into a retracted position in which it is withdrawn from the upper workpiece (86), wherein a lower sword (68, 68') for receiving an intermediate workpiece (82) is disposed between the upper sword (71, 71') and the workpiece-receiving plate (14), and is movable into a lower working position on the workpiece-receiving plate (14) and an upper working position above the workpiece-receiving plate (14) and under the upper sword (71, 71'), wherein the lower sword (68, 68') is movable into a retracted position in which it is withdrawn from the intermediate workpiece (82), wherein the upper sword (71, 71') and the lower sword (68, 68') are movable relative to each other into a position adjacent to each other and into a position spaced from each other, and wherein folding modules (77) allocated to the lower sword (68, 68') are mounted on the outer frame (53, 53').

2. A folding device according to claim 1, wherein the upper sword (71, 71') and the lower sword (68, 68') are disposed on a common sword support (63, 63').

3. A folding device according to claim 2, wherein the lower sword (68) is movable by means of a linear drive (69) engaging on the support (63).

4. A folding device according to claim 1, wherein the upper sword (71) and the lower sword (68) are movable parallel to each other by a straight-line mechanism (65, 66, 69).

5. A folding device according to claim 1, wherein the folding modules (74) allocated to the upper sword (71) are disposed on an upper side of the outer frame (53), and wherein the folding modules (77) allocated to the lower sword (68) are disposed on an underside of the outer frame (53).

6. A folding device according to claim 1, wherein a support bearing (119) is disposed in the workpiece-receiving plate (14), which is movable out of the workpiece-receiving plate (14) and by means of which the lower sword (68') is movable into the position adjacent to the upper sword (71').

7. A folding device according to claim 6, wherein the support bearing (119) comprises a piston-cylinder drive (120), which is provided with a support (124) movable through an opening (123) of the workpiece-receiving plate (14).

8. A folding device according to claim 6, wherein the lower sword (68') is pivotably joined to the upper sword (71').

9. A folding device according to claim 6, wherein in its position spaced away from the upper sword (71'), the lower sword (68') is arrested relative to the upper sword (71') by at least one stop (118).

* * * * *

US005611468B1

REEXAMINATION CERTIFICATE (3870th)

United States Patent [19]

Schulze et al.

[11] B1 5,611,468

[45] Certificate Issued Sep. 7, 1999

[54] FOLDING DEVICE FOR AN AUTOMATIC SEWING MACHINE

[75] Inventors: Wolfram Schulze, Bielefeld, Germany; John Couch, Stone Mountain, Ga.; Wolfgang Grosser, Bielefeld; Herbert Zielinski, Spenge, both of Germany

[73] Assignee: Durkopp Adler Aktiengesellschaft, Bielefeld, Germany

Reexamination Request:
No. 90/004,774, Oct. 9, 1997

Reexamination Certificate for:

| | |
|---|---|
| Patent No.: | **5,611,468** |
| Issued: | **Mar. 18, 1997** |
| Appl. No.: | **08/647,239** |
| Filed: | **May 9, 1996** |

[30] Foreign Application Priority Data

| | | | |
|---|---|---|---|
| May 24, 1995 | [DE] | Germany | 195 19 027 |
| Mar. 7, 1996 | [DE] | Germany | 196 08 779 |

[51] Int. Cl.[6] ..... A41H 33/00

[52] U.S. Cl. ..... 223/38; 223/37; 112/470.07; 112/470.16; 112/470.06

[58] Field of Search ..... 223/38, 37; 112/470.07, 112/470.16, 470.06

[56] References Cited

U.S. PATENT DOCUMENTS

| | | |
|---|---|---|
| 4,463,697 | 8/1984 | Vogt et al. . |
| 4,819,572 | 4/1989 | Scholl et al. . |

FOREIGN PATENT DOCUMENTS

| | | |
|---|---|---|
| 31 39 223 C2 | 11/1994 | Germany . |

*Primary Examiner*—Bibhu Mohanty

[57] ABSTRACT

Above a workpiece-receiving plate for an lower workpiece, a folding device for an automatic sewing machine comprises two swords, namely a lower sword and an upper sword for receiving an intermediate workpiece and an upper workpiece, respectively. For the folding of the intermediate workpiece about the outer edges of the lower sword, folding modules are mounted on the underside of an outer frame. For the folding of the upper workpiece about the outer edges of the upper sword, folding modules are provided on the upper side of the outer frame. The swords are mounted on a common carriage and movable in height relative to each other. The carriage iself is likewise displaceable in height.

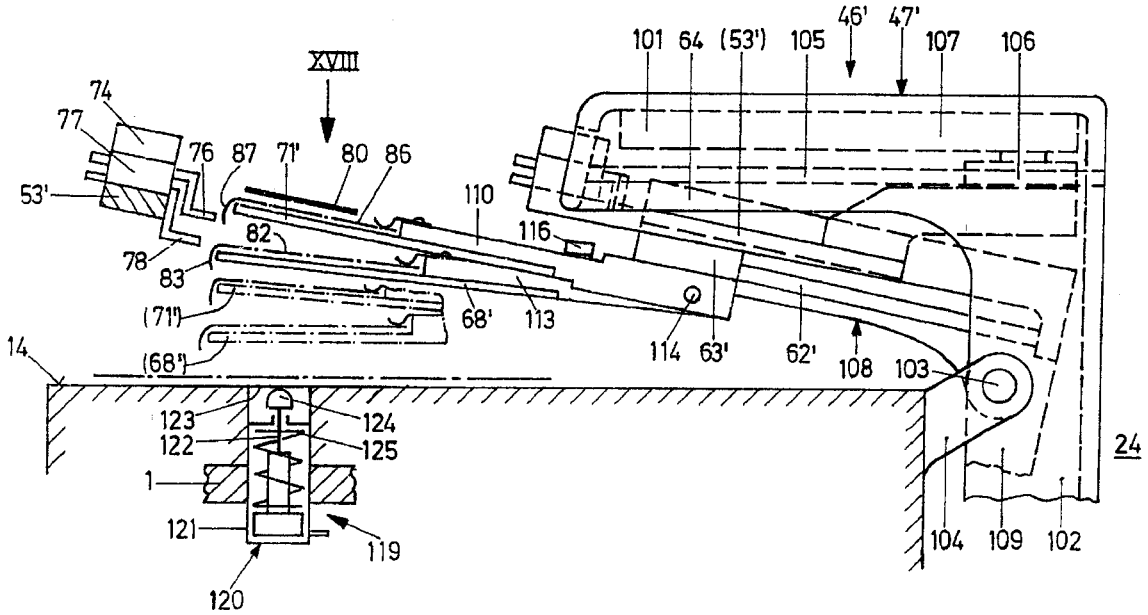

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–9 is confirmed.

* * * * *